US006557811B1

(12) United States Patent
Burns

(10) Patent No.: US 6,557,811 B1
(45) Date of Patent: May 6, 2003

(54) TABLE STAND FOR BOOKS OR SHEET MUSIC

(76) Inventor: Daniel Burns, 211 Pearl St., Pittsburgh, PA (US) 15224

( * ) Notice: Subject to any disclaimer, the term of this patent is extended or adjusted under 35 U.S.C. 154(b) by 0 days.

(21) Appl. No.: 09/417,215

(22) Filed: Oct. 13, 1999

(51) Int. Cl.[7] ..... A47B 97/04
(52) U.S. Cl. ..... 248/460; 248/455; 248/459
(58) Field of Search ..... 248/460, 441.1, 248/446, 453, 456, 459, 165, 174

(56) References Cited

U.S. PATENT DOCUMENTS

| | | | | | |
|---|---|---|---|---|---|
| 2,014,176 | A | * | 9/1935 | Henderson | 248/456 |
| 2,726,835 | A | * | 12/1955 | Hummel | 248/459 |
| 2,784,929 | A | * | 3/1957 | Diening | 248/453 |
| 4,355,779 | A | | 10/1982 | Heled | |
| 4,544,123 | A | * | 10/1985 | Peacock | 248/460 |
| 4,607,817 | A | * | 8/1986 | Aquino | 248/459 |
| 4,709,895 | A | * | 12/1987 | Mardak | 248/460 |
| 4,886,231 | A | * | 12/1989 | Doerksen | 248/455 |
| D314,873 | S | | 2/1991 | Wenger et al. | |
| 5,080,316 | A | * | 1/1992 | MacEwan | 248/459 |
| 5,114,111 | A | | 5/1992 | Andrews | |
| 5,467,958 | A | | 11/1995 | Selvaggio | |
| 5,564,661 | A | | 10/1996 | Gershon | |
| 5,722,628 | A | * | 3/1998 | Menaged | 248/441.1 |
| 5,765,799 | A | | 6/1998 | Weber | |
| 5,884,889 | A | * | 3/1999 | Crosby | 248/460 |

FOREIGN PATENT DOCUMENTS

GB 2260265 A 4/1993

* cited by examiner

*Primary Examiner*—Anita King
(74) *Attorney, Agent, or Firm*—Greenberg & Lieberman; Michael L. Greenberg, Esq.

(57) ABSTRACT

A triangular-shaped portable collapsible stand to accommodate either sheet music or books. It is a three-piece stand is designed for table top use. It is assembled by sliding angled slots into grooves.

12 Claims, 1 Drawing Sheet

TABLE STAND FOR BOOKS OR SHEET MUSIC

FIELD OF THE INVENTION

The present invention relates generally to stands to accommodate books or sheet music therefore and more particularly to table-mounted portable stands that accommodate books and sheet music.

BACKGROUND OF THE INVENTION

Musicians require stands upon which to place sheet music for use in performance or practice. When they perform, they must often provide their own stands upon which they place the sheet music for the pieces to be performed. Therefore, they require portable stands that are easy to set up and carry. Portable music stands are often also necessary for a musician's private use when practicing; a musician may not have the space required in his or her home or studio to accommodate a full-sized music stand. Furthermore, a portable music stand which is designed to rest upon an existing table top could be very convenient for a musician to use in either a home or studio or to take with him or her when performing in public.

A portable, table-top stand to hold open books can be used in many different ways in the home. Cookbooks must be held open to a specific page when referred to, and the cook cannot hold open the cookbook and prepare the recipe simultaneously. Similarly, when books are used to assist in home or auto repairs, the person doing the work cannot both hold open the reference book and do the work. Stands with legs are completely impractical for either of these uses.

There are a variety of tripodal portable stands on the market accommodating either sheet music or books. Examples of these are U.S. Pat. No. 4,355,779, issued to Heled on Oct. 26, 1982; U.S. Pat. No. Des. 314,873, issued to Wenger, et al. on Feb. 26, 1991; U.S. Pat. No. 5,114,111, issued to Andrews on May 19, 1992; and British Patent No. 2,260,265 A, issued Apr. 14, 1993, and U.S. Pat. No. 5,564,661, issued Oct. 15, 1996, both issued to Gershon.

U.S. Pat. No. 5,467,958, issued to Selvaggio on Nov. 21, 1995, is not for a portable stand to accommodate either books or sheet music, but rather one to accommodate small or large documents, drawings, blueprints, or rigid displays.

U.S. Pat. No. 5,754,799, issued to Weber on Jun. 16, 1998, is for a portable stand to hold open the pages of a book. It differs from the present invention in several significant ways. First, the Weber is a hinged design which will collapse in upon itself when not in use, whereas the present invention is a three-piece grooved design separating into parts when not used. The hinged design of the Weber makes it impractical to accommodate sheet music, whereas the present invention is designed to accommodate either sheet music or books. Lastly, the dimensions of the Weber simply are not wide enough to accommodate sheet music, while the present invention can accommodate either books or sheet music.

Therefore, a need has been established for a novel collapsible portable stand designed for table-top use which may accommodate either sheet music or books.

It is an object of the present invention to provide a portable collapsible stand to accommodate either sheet music or books.

It is also an object of the present invention to provide a stand for sheet music or books to be used on a table top.

It is further an object of the present invention to provide a portable collapsible stand that is easily assembled and collapsed.

It is another object of the present invention to provide a stand that is simple in design and inexpensive to manufacture.

SUMMARY OF THE INVENTION

The present invention presents a novel portable collapsible stand to accommodate either sheet music or books. While other portable collapsible stands for sheet music or books are designed to stand on a floor, the present invention is designed to be used on a table top. The present invention presents a unique three-piece design which is easily assembled and disassembled.

DETAILED DESCRIPTION OF THE PREFERRED EMBODIMENTS

Figure 1:
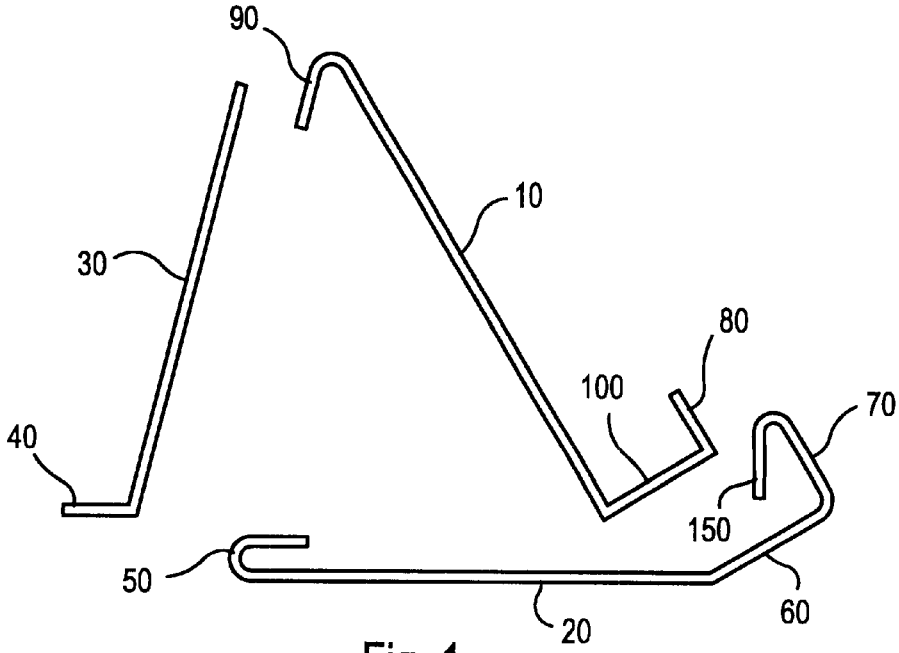
FIG. 1 is a side view of the three individual pieces of the present invention.

Referring to FIG. 1, an unassembled side view of the present invention, the table stand comprises a first, second, and third piece (10, 20, and 30), respectively. In the preferred embodiment of the present invention, first, second, and third pieces (10, 20, 30) are light weight, molded, flat pieces.

It is desirable that the first piece (10) has a flat and angled surface because such contouring makes first piece (10) better able to serve as the resting place for a book or sheet music. First piece (10) is considered to be the front of the present invention since it serves as the resting place for a book or sheet music that will face the user.

At its upper end, first piece (10) has a back-facing bend (90). At its lower end, first piece (10) has a front facing ledge (100) which ends with a vertical bend (80). The bottom of a book or sheet music (not shown) can rest on front-facing ledge (100), and in such case, vertical bend (80) provides support for the front of the book or sheet music so as to maintain positioning on the present invention.

Second piece (20) is considered the base of the present invention. The front end of second piece (20) has an obtuse angle (60) and a first and second engagement bend (70, 150). It is desirable, for reasons provided later, that the obtuse angle (60) and the first engagement bend (70) correspond closely to frontfacing ledge (100) and vertical bend (80) so that they can interlock. The back end of piece (20) has a hook-shaped bend (50).

Third piece (30) is considered to be the back side of the present invention. Third piece (30) has a flange (40) at its lower end. It is desirable, for reasons provided later, that flange (40) correspond closely to hook-shaped bend (50) so that they can interlock.

Figure 2:
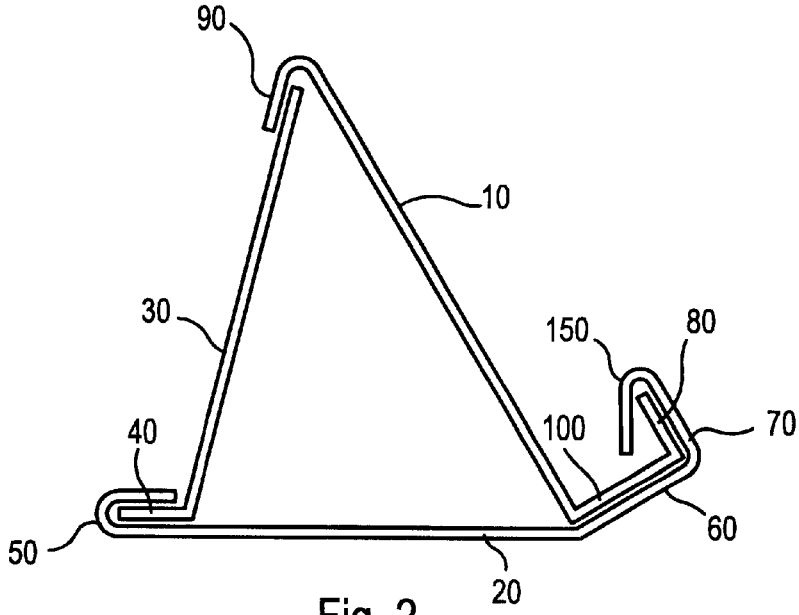
FIG. 2 is a side view of the assembled present invention showing how the three pieces of the present invention fit together.

Referring to FIG. 2, an assembled side view of the present invention, the first, second, and third pieces (10, 20, 30) are slid together to interlock into a triangular-shaped frame: second piece (20) forms the base of the present invention, third piece (30) forms the back side of the present invention, and first piece (10) forms the front side of the present invention.

The hook-shaped end (50) of second piece (20) interlocks with flange (40) of third piece (30) to frictionally engage. In addition, obtuse angle (60) and first and second engagement bends (70) and (150) interlock with vertical bend (80) and front-facing ledge (100) to frictionally engage. In this way, first piece and second piece connect together. First piece (10) and third piece (30) interlock to form an apex of the present invention because the back-facing bend (90) frictionally engages at the upper end of third piece (30).

In one embodiment, the present invention measures 14 inches in height by 16 inches in length by 8 inches in width. The size of the present invention may be varied according to its use; it may be larger to accommodate larger documents or smaller for use as a toy. It may be molded inexpensively in either plastic or metal. Wood construction would provide an attractive appearance, but the amount of handwork required to make the first, second, and third pieces (10, 20, 30) and their corresponding ends would render the present invention too expensive for practical use. Furthermore, should wood construction be employed, frictionally engaging pieces might warp and not correspondingly mate.

Primarily, the present invention is a portable, collapsible stand to accommodate either sheet music or books. It is to be understood that the present invention is not limited to the embodiments described above, but encompasses any and all embodiments within the scope of the following claims.

I claim:

1. A portable stand, comprising:

a first piece;

a second piece, having an congruous end adapted to engage said first piece; and a third piece, having a terminus adapted to engage said first piece and an end adapted to engage said second piece;

wherein said first piece, said second piece, and said third piece engage one another to form a structurally sound self-supporting configuration that is an equilateral triangle in shape.

2. The stand of claim 1, wherein said first piece, said second piece, and said third piece form a equilateral triangle configuration by means of fixedly attached flanges as congruous pieces at the ends of said first piece, said second piece, and said third piece.

3. The stand of claim 1, wherein said first piece has a back-facing bend for communication with said third piece; and said back-facing bend is a congruous part of said first piece.

4. The stand of claim 1, wherein said first piece has a front-facing ledge and said first piece has a vertical bend at the end of said front-facing ledge.

5. The stand of claim 1, wherein said end adapted to engage said first piece comprises a first engagement bend and a second engagement bend.

6. The stand of claim 1, wherein said end on said second piece adapted to engage said first piece comprises an obtuse angle, a first engagement bend, and second engagement bend.

7. A portable stand, comprising:

a first piece;

a second piece, having an end adapted to engage said first piece, wherein said end adapted to engage said first piece comprises an obtuse angle, a first engagement bend, and second engagement bend and said end adapted to engage said first piece communicates with a front-facing ledge and vertical bend of said first piece; and a third piece, having a terminus adapted to engage said first piece and an end adapted to engage said second piece;

wherein said first piece, said second piece, and said third piece engage one another to form a self-supporting configuration.

8. A portable stand, comprising:

a first piece;

a second piece, having an end adapted to engage said first piece;

a third piece, having a terminus adapted to engage said first piece and an end adapted to engage said second piece;

wherein said second piece has a means to engage said third piece; and said means to engage said third piece is a hook-shaped bend;

wherein said first piece, said second piece, and said third piece engage one another to form a self-supporting equilateral triangle configuration.

9. The stand of claim 8, wherein said terminus on said third piece adapted to engage said first piece is a linear end which is fixedly attached to said third piece.

10. The stand of claim 8, wherein said end on said third piece adapted to engage said second piece comprises a flange which is fixedly attached to said third piece.

11. A portable stand, comprising:

a first piece;

a second piece, having an end adapted to engage said first piece; and a third piece, having a terminus adapted to engage said first piece and an end adapted to engage said second piece;

wherein said first piece, said second piece, and said third piece engage one another to form a self-supporting configuration wherein said end adapted to engage said second piece communicates with a hook-shaped bend of said second piece.

12. The stand of claim 11, wherein said end adapted to engage said second piece comprises a flange.

* * * * *